United States Patent [19]

Sabatie et al.

[11] Patent Number: 4,669,523

[45] Date of Patent: Jun. 2, 1987

[54] CASTINGS AND THEIR PRODUCTION PROCESS

[75] Inventors: Michele Sabatie, Luzarches; Michel Maree, Gif sur Yvette, both of France

[73] Assignee: Aerospatiale, Societe Nationale Industrielle, Paris, France

[21] Appl. No.: 879,148

[22] Filed: Jun. 26, 1986

[30] Foreign Application Priority Data

Jul. 4, 1985 [FR] France ..... 85 10221

[51] Int. Cl.[4] ..... B22D 19/14

[52] U.S. Cl. ..... 164/97; 164/98; 164/106; 164/110

[58] Field of Search ..... 164/97, 98, 100, 106, 164/108, 110

[56] References Cited

U.S. PATENT DOCUMENTS

| | | | |
|---|---|---|---|
| 1,484,434 | 2/1924 | Thompson | 164/110 |
| 4,216,682 | 8/1980 | Ban et al. | 164/97 |
| 4,534,266 | 8/1985 | Huet | 164/110 |
| 4,570,316 | 2/1986 | Sakamaki et al. | 164/97 |

FOREIGN PATENT DOCUMENTS

| | | | |
|---|---|---|---|
| 92437 | 5/1985 | Japan | 164/97 |

*Primary Examiner*—Nicholas P. Godici
*Assistant Examiner*—Samuel M. Heinrich
*Attorney, Agent, or Firm*—Pearne, Gordon, McCoy & Granger

[57] ABSTRACT

The present invention relates to castings constituted by a metal matrix reinforced by fibres and having outgrowths.

Firstly, a reinforcing framework is produced, which is incorporated into the fibrous strengthening member, the complete entity being placed in a mould and the metal matrix is cast. The latter penetrates the fibrous strengthening member and the reinforcing framework. The latter is positioned at the location of an outgrowth which, after solidification of the metal matrix, is consequently reinforced.

Application to the production of castings having fixing tabs or lobes.

9 Claims, 16 Drawing Figures

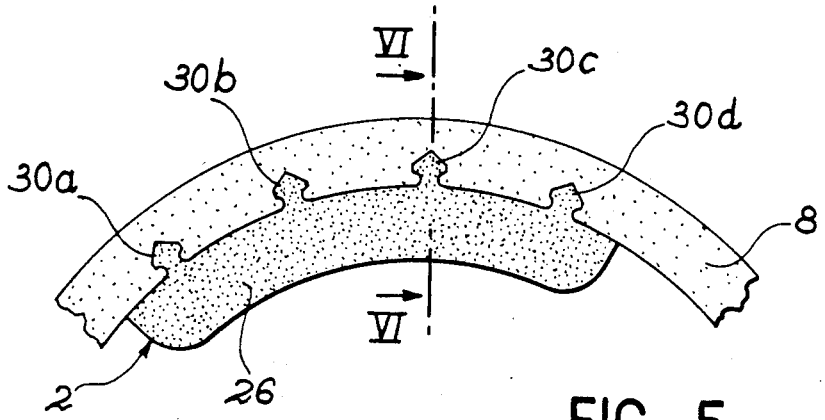
FIG. 5
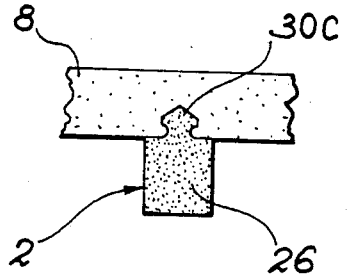
FIG. 6
FIG. 7
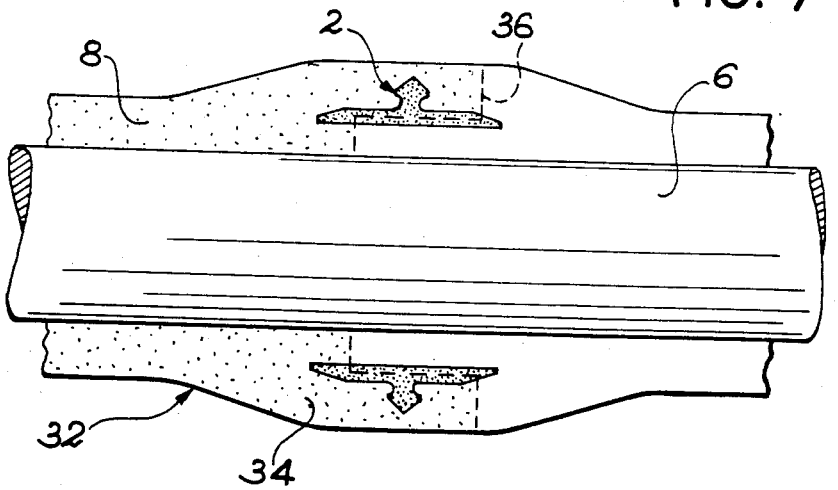

CASTINGS AND THEIR PRODUCTION PROCESS

BACKGROUND OF THE INVENTION

The present invention relates in general terms to the production of metal or light alloy castings and more specifically applies to the production of members of this type constituted by a metal matrix reinforced by fibres and which have excrescences or outgrowths, such as fixing tabs, lobes, etc.

In the production of light alloy castings, important advances have made it possible to obtain distinctly improved mechanical characteristics. One of the solutions used consists of reinforcing the metal matrixes by incorporating fibres with strong mechanical characteristics. The most widely used fibres are those of alumina, boron, carbon, silicon carbide, silicon, ceramic, etc. This leads to a significant improvement to the mechanical characteristics at ambient temperature, but with a limited elongation at break, whilst there is also a definite improvement to the thermal behaviour. Thus, in the case of alloy 2024, the introduction of 30% of short silicon carbide fibres leads to a tensile strength at 350° C. identical to that obtained at 250° C. with the same metal, but not reinforced by fibres. The latter can be in the form of long, continuous fibres, which can be woven or wound, in the form of short fibres, whose length can vary from a few micrometers to a few centimeters, or in the form of particles, such as ground, equiaxial polycrystals, whose diameter is approximately 2 to 3 micrometers, or crystal whiskers in the form of monocrystals of diameter 0.1 to 2 micrometers and a length generally below 100 micrometers.

The characteristics obtained and the technologies used differ according to the type of fibre used as the reinforcement. Thus, in the case of reinforcements constituted by uniformly distributed short fibres average non-oriented characteristics are obtained, but it is possible to obtain small spheres which could then be transformed by deformation (forging, forming, drawing, etc.). However, in the case of reinforcements constituted by continuous fibres, they do not permit any subsequent transformation which would lead to fibre break and instead lead to high characteristics which can also be oriented in accordance with privileged directions.

There are at present several methods for obtaining long fibres. For example, it is possible to metallize a layer of fibres, then heat it and compress it, or extrude a profile or section into which is introduced, during drawing, continuous fibres. French specification 2,363,636 describes a higher performance and more easily industrializable method, which consists of casting or pouring the matrix into a previously made fibrous preform and placed in the mould before casting. Different methods can be used for producing such preforms. For example, it is possible to superimpose fabrics, layers or gauzes inclined in a different manner, or wind a certain number of filaments onto a core, if the part is of revolution. It is also possible to use a multidimensional woven preform.

The structures obtained with such methods generally have remarkable properties both at ambient temperature and at temperatures of approximately 300° to 350° C. These mechanical properties are superior to those of the metal matrix used. These methods lead to simple parts of constant thickness, for which the production of fibrous preforms is easy and the corresponding technology well adapted. However, parts having a simple shape only have limited uses. The sphere of use of the light alloy castings is increased by the crude casting of parts which, apart from a simple general surface, have zones with specific functions, i.e. various bosses or lobes, fixing tabs, connecting zones, etc., i.e. important local outgrowths.

With the methods defined hereinbefore, the continuous fibre preform constituting the general reinforcement of the casting cannot easily be adapted to the strengthening of the local outgrowths. Thus, in the final part, the zones not reinforced by fibres only have the same performance characteristics as the basic matrix. Thus, they constitute the same number of weak points and this is particularly prejudicial, because such outgrowths often serve as connecting or fixing means.

SUMMARY OF THE INVENTION

The present invention aims at obviating these disadvantages by proposing castings constituted by a metal matrix reinforced by a fibrous strengthening part and having outgrowths, which themselves have good mechanical characteristics.

According to the main feature of the castings according to the invention, they have a solid part constituted by a metal matrix reinforced by a fibrous strengthening member and at least one outgrowth, which comprises a non-metallic reinforcing framework, whereof at least part is incorporated into the fibrous strengthening member.

The expression "solid part" used within the present description designates that portion of the casting having a sufficiently simple shape to be produced in the form of a fibre-reinforced metal matrix, as opposed to the outgrowths.

The invention more particularly applies to castings, whose metal matrix is made from a material chosen from the group constituted by aluminum, magnesium, silicon and titanium.

According to another feature of the invention, the fibrous strengthening member and the reinforcing framework are made from a refractory material. Throughout the present description, the term "refractory material" is understood to mean a material, whose melting point is above 1300° C. Materials particularly suitable for the present purposes are e.g. alumina, boron, silicon, silicon carbide, silicon nitride, aluminium nitride, magnesium oxide, titanium carbide, graphite, beryllium oxide, boron carbide, nickel oxide, nickel bromide, selenium, etc.

The present invention also relates to a process for the preparation of such castings. According to the main feature of the present process, it comprises the following stages consisting of:

(a) partly producing the fibrous strengthening member on a part constituting the die of the mould, (b) separately producing a reinforcing framework, (c) incorporating at least part of the reinforcing framework into the fibrous strengthening member, (d) finishing the fibrous strengthening member and placing it in the mould, and (e) casting the metal matrix in the closed mould, so as to completely fill all the spaces within the fibrous strengthening member and the reinforcing framework.

In certain cases, the process can involve a supplementary stage, performed after stage (b) and which consists of covering at least part of the reinforcing framework by a protective cap. The latter is preferably made from a material able to melt during the pouring or casting of the metal matrix.

The reinforcing framework can be produced in different ways, e.g. it is possible to compress particles or fibres mixed with an organic binder or carry out a multidimensional weaving of the fibres. The framework can also be produced by winding or rolling a fabric, which can itself be positioned on a core of particles or fibres produced from the same material as the fabric.

In the case where the reinforcing framework has fringes, the process involves a supplementary stage, performed after stage (b) and which consists of spreading out the fringes by flattening over part of the fibrous strengthening member.

Finally, in certain cases, it may be advantageous to use a meltable barb or pin incorporated into the fibrous strengthening member and onto which is threaded the reinforcing framework during stage (c).

BRIEF DESCRIPTION OF THE DRAWINGS

The invention is described in greater detail hereinafter relative to non-limitative embodiments and the attached drawings, wherein show:

FIG. 5 A view similar to FIG. 4, but in the case of a cylindrical part.

FIG. 6 A sectional view along line VI—VI of FIG. 5.

FIG. 7 A diagrammatic sectional view showing how the reinforcing framework is placed in a cylindrical member before being machined at said framework.

DETAILED DESCRIPTION OF THE PREFERRED EMBODIMENTS

Figure 1:
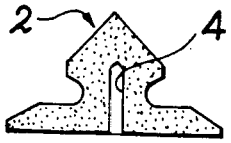
FIG. 1 A diagrammatic sectional view of a reinforcing framework.

FIG. 1 shows a reinforcing framework 2, which, in the particular case described here, has a symmetry of revolution and is constituted by crystal whiskers, particles or short fibres agglomerated by pressing or compressing with an organic binder. The framework 2 has an elongated cylindrical recess 4, whose function will be described hereinafter with reference to FIGS. 2*a* to 2*e*.

Figure 2A:
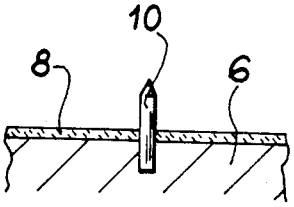
FIGS. 2*a* to 2*e* The different production stages of a casting according to the invention.
Figure 2B:
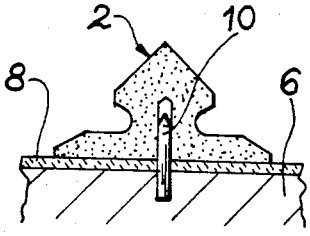
Figure 2C:
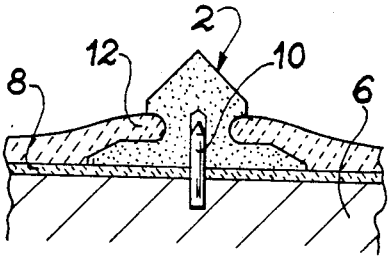
Figure 2D:
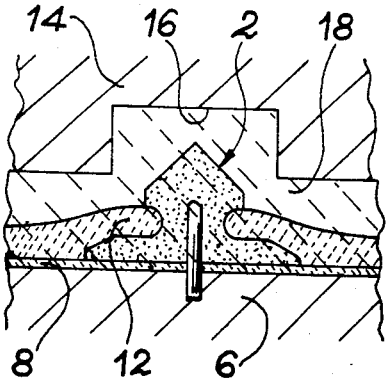
Figure 2E:
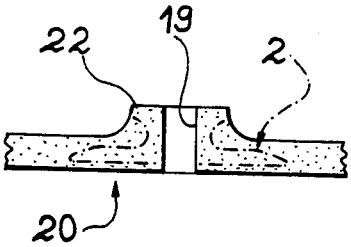

These drawings illustrate the different production stages of a casting according to the invention. FIG. 2*a* shows that a layer of fibres 8 has been placed in contact with part 6 of the mould and into it will be subsequently poured or cast the metal matrix. The mould part 6 can be a cylindrical mandrel, if the casting to be produced has a generally tubular shape. A pin or barb 10 is stuck into the mould part 6 and surrounded over a small proportion of its length by the fibre layer 8. The following stage consists of putting into place the reinforcing framework 2 by threading it on to the pin 10 via recess 4. The use of a pin such as 10 permits a good fitting accuracy of reinforcing framework 2, the maintaining in place of the latter being ensured by tightening between its central bore 4 and the pin 10. On said fibre layer 8 is then placed another fibre layer 12, so as to at least partly grip round the reinforcing framework, as illustrated in FIG. 2*c*. The mould is then closed in such a way that the fibre layers 8, 12 and the reinforcing framework 2 are located between the first element 6 and the second element 14 thereof (FIG. 2*d*). It is possible to see in the latter that the mould part 14 has a recess 16 in the vicinity of the reinforcing framework 2 when the mould is closed. The metal matrix 18 is then cast between mould parts 6 and 14, so that the molten metal fills all the gaps of the fibre layers 8, 12, as well as the reinforcing framework 2. The metal matrix also fills the mould cavity 16. Pin 10 is made from a material having a sufficiently low melting point that it melts at the time of casting matrix 18. Once the latter has solidified, the casting is extracted from the mould and it is possible to carry out machining, if this is necessary. FIG. 2*e* shows an example of such machining, where casting 20 has a bore 19 in an area in which is located a local reinforcement or outgrowth 22. The dotted line of FIG. 2*e* shows the initial location of the reinforcing framework 2.

It can be seen that in the particular case of FIG. 2*e*, the particles constituting this framework are located in outgrowth 22, which is consequently reinforced and has the same mechanical characteristics as the remainder of casting 20.

On putting into place the fibre layer 12 of FIG. 2*c*, said fibres may be subject to stresses or tensions liable to deteriorate the surface of framework 2, which is relatively brittle. In order to protect the latter, it may be advantageous to cover it with a protective cap, in the manner illustrated in FIG. 3.

Figure 3:
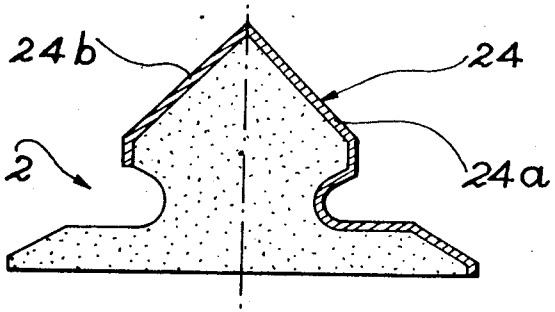
FIG. 3 A diagrammatic sectional view showing how it is possible to protect a reinforcing framework with the aid of a protective cap.

In FIG. 3 it is possible to see that the framework 2, which has the same shape as in the preceding drawings, is covered with a protective cap 24. In the right-hand part of the drawing, cap 24*a* completely covers framework 2, whereas in the left-hand part thereof, cap 24*b* only partly covers it. Cap 24 is made from a thin metal (e.g. 0.1 mm thick), which is compatible with the material constituting the framework and fibres. Moreover, this material is able to melt during the infiltration of the matrix.

Figure 4:
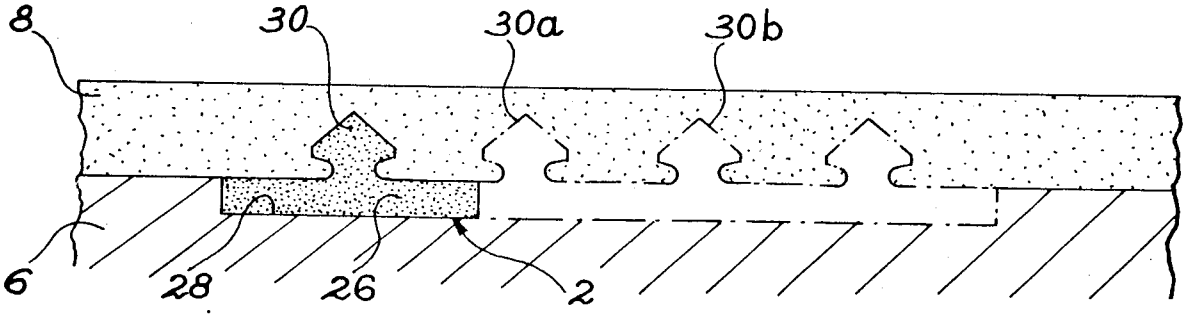
FIG. 4 A diagrammatic sectional view showing how it is possible to place the reinforcing framework in the mass of fibres in the case of a planar part.

FIG. 4 illustrates another example in which the reinforcing outgrowths are located within a casting. In this case, the reinforcing framework 2 has a body 26 and an anchoring part 30. Body 26 is placed in a cavity 28 of mould 6, whilst the anchoring part 30 is trapped by the fibre layer 8 at the time of putting the latter into place. The reinforcing framework 2 can have a single anchoring part 30, as shown by continuous lines in FIG. 4, or several such parts, if the reinforcing framework has larger dimensions and as illustrated by the broken lines in the same drawing (anchoring parts 30*a*, 30*b*, etc.). Obviously, in this case, it is also possible for the framework 2 or at least the anchoring part 30 to be covered by a protective cap, as in the case of FIG. 3.

FIGS. 5 and 6 illustrate a variant similar to that of FIG. 4, but in which the part to be produced is cylindrical and in the particular case described here, the reinforcing framework 2 has a body 26 and four anchoring parts 30*a* to 30*d*.

FIG. 7 illustrates the application of the invention to the production of a cylindrical part 32 having at a particular point an enlargement 34, which can be machined to a predetermined shape. As hereinbefore, use is made of a mandrel 6 about which is arranged or wound a fibre layer 8. Within the latter are placed one or more reinforcing frameworks 2, which can optionally be in the form of a continuous framework, as in the case of FIGS. 5 and 6.

As hereinbefore, the initial procedure involves placing in a mould, followed by the casting of the metal matrix and allowing the latter to solidify. This is followed by machining along the broken line 36 in FIG. 7, framework 2 being positioned at the enlargement 34, which is reinforced and has mechanical characteristics similar to those of the remainder of the casting.

Figure 8:
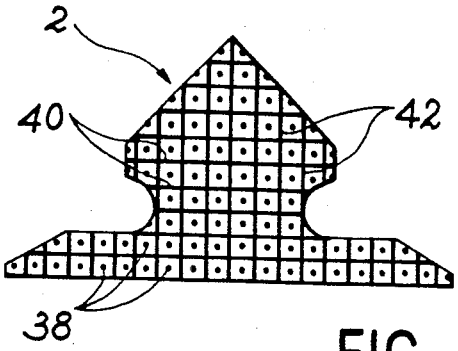
FIG. 8 A diagrammatic sectional view of a reinforcing framework obtained by three-dimensional weaving of the fibres.
Figure 8:
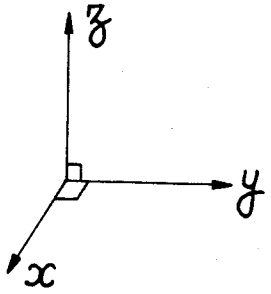

The sectional view of FIG. 8 illustrates a variant in which the reinforcing framework 2 has the same external shape as in FIG. 1 but, instead of being produced by the agglomeration of particles with an organic binder, it is produced by three-dimensional weaving of fibres. The fibres, such as 38 are located in direction x perpendicular to the plane of the drawing, whilst fibres 40 and 42 are in the plane of the drawing and oriented in directions y and z respectively.

Figure 9A:
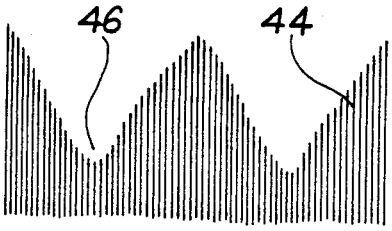
FIGS. 9*a* to 9*d* Diagrammatic views showing the different stages of producing a casting according to the invention, when the reinforcing framework is produced by winding or rolling a fabric.
Figure 9B:
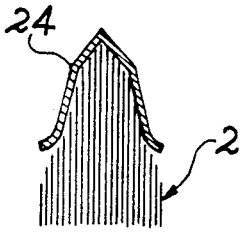
Figure 9C:
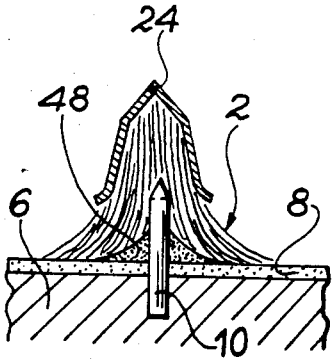
Figure 9D:
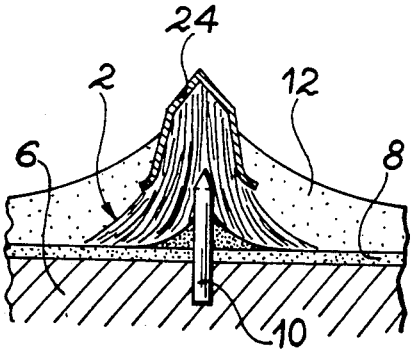

FIGS. 9*a* and 9*d* illustrate the case where the reinforcing framework is produced by winding a fabric. FIG. 9*a* shows that the reinforcing framework is in the form of a fringed fabric 44 having notches 46, which is then wound onto itself to give it the shape illustrated in FIG. 9*b*. Winding takes place in such a way that framework 2 has a substantially conical shape and it is protected by a cap 24 which, in the particular case described here, is a partial cap. The following stage consists of spreading the fibres or fringes of framework 2 by threading the latter onto a pin 10 similar to that used in the variant of FIGS. 2*a* to 2*e*. This spreading can optionally be facilitated by the fitting of a substantially conical core 48 and made from the same material as framework 2 in FIG. 1. Cone 48 is itself centered on pin 10. This is followed by the fitting of a second fibre layer 12 (FIG. 9*d*), so as to at least partly cover the framework 2. The mould is then closed and the matrix cast in the manner described hereinbefore.

The invention provides particularly interesting advantages, because it makes it possible to obtain in a simple manner castings with outgrowths or lobes with mechanical characteristics comparable to those of the solid part of the casting. Finally, it is obvious that the invention is not limited to the examples described hereinbefore and that numerous variants thereto are possible without passing beyond the scope of the invention. Thus, as a function of the particular case, the Expert can adapt the shape of the reinforcing framework and the means for fixing the same to the fibrous strengthening member in which the matrix is to be cast. With regards to the possible materials, the lists given hereinbefore are not limitative and the invention is applicable no matter what the material used for producing the casting, the fibrous strengthening member or the reinforcing frameworks.

What is claimed is:

1. A process for the preparation of a casting incorporating a solid part constituted by a metal matrix reinforced by a fibrous strengthening member and at least one metal outgrowth, wherein it comprises the following stages consisting of:

(a) partly producing the fibrous strengthening member on a support constituting the die of the mould,
(b) separately producing a reinforcing framework,
(c) incorporating at least part of the reinforcing framework into the fibrous strengthening member,
(d) placing the fibrous strengthening member in the mould, and
(e) casting the metal matrix in the closed mould, so as to completely fill all the spaces within the fibrous strengthening member and the reinforcing framework.

2. A process according to claim 1, wherein it comprises a supplementary stage, performed after stage (b) and which consists of at least partly covering the reinforcing framework with a protective cap.

3. A process according to claim 2, wherein the protective cap is made from a material able to melt during the casting of the metal matrix.

4. A process according to claim 1, wherein the reinforcing framework is produced by the compression of particles or fibres with an organic binder.

5. A process according to claim 1, wherein the reinforcing framework is produced by the multidimensional weaving of fibres.

6. A process according to claim 1, wherein the reinforcing framework is produced by the winding of a fabric.

7. A process according to claim 6, wherein the fabric is positioned on a particle or fibre core made from the same material as the fabric.

8. A process according to claim 1, wherein the reinforcing framework has fringes and includes a supplementary stage, performed after stage (b) and which consists of spreading the fringes by flattening over part of the fibrous framework.

9. A process according to claim 1, wherein use is made of a meltable pin incorporated into the fibrous strengthening member and onto which is threaded the reinforcing framework during stage (c).

* * * * *